US005268702A

United States Patent [19]

Amano et al.

[11] Patent Number: 5,268,702

[45] Date of Patent: Dec. 7, 1993

[54] P-TYPE ANTENNA MODULE AND METHOD FOR MANUFACTURING THE SAME

[75] Inventors: Toshiaki Amano; Hirokazu Shiroishi; Kenichi Fuse, all of Tokyo; Yutaka Higashiguchi, Kawasaki; Hirotaka Kashiwabara, Kawasaki; Mitsuo Inagaki, Kawasaki; Hidehiro Mishiro, Kawasaki, all of Japan

[73] Assignees: The Furukawa Electric Co., Ltd., Tokyo; Fujitsu Limited, Kanagawa, both of Japan

[21] Appl. No.: 858,209

[22] Filed: Mar. 26, 1992

[30] Foreign Application Priority Data

May 2, 1991 [JP] Japan ..... 3-128248

[51] Int. Cl.[5] ..... H01Q 1/48; H01Q 1/24

[52] U.S. Cl. ..... 343/846; 343/700 MS; 343/702; 343/873; 264/261

[58] Field of Search ..... 343/846, 700 MS, 702, 343/873, 728, 741, 745, 748, 829, 831, 845, 866; 264/261

[56] References Cited

U.S. PATENT DOCUMENTS

| | | | |
|---|---|---|---|
| 3,780,373 | 12/1973 | Holst et al. | 343/846 |
| 4,063,246 | 12/1977 | Greiser | 343/846 |
| 4,701,763 | 10/1987 | Yamamoto et al. | 343/700 MS |
| 4,775,866 | 10/1988 | Shibata et al. | 343/700 MS |
| 4,907,006 | 3/1990 | Nishikawa et al. | 343/713 |

*Primary Examiner*—Donald Hajec
*Assistant Examiner*—Hoanganh Le
*Attorney, Agent, or Firm*—Frishauf, Holtz, Goodman & Woodward

[57] ABSTRACT

A ground conducting layer and an antenna element conducting layer are set at a predetermined position in a cavity of a molding die, and molten resin is injected into the cavity, thereby molding a resin-formed member in which said ground conducting layer and said antenna element conducting layer are integrated. As a result of this, there can provided an antenna module comprising a resin member formed by molding to be a predetermined shape, a sheet-like ground conducting layer adhered to one surface of the resin member, a sheet-like antenna element conducting layer adhered to another surface opposing to the one surface of said resin member, and a feeder for feeding electricity to the antenna element conducting layer.

16 Claims, 8 Drawing Sheets

P-TYPE ANTENNA MODULE AND METHOD FOR MANUFACTURING THE SAME

BACKGROUND OF THE INVENTION

1. Field of the Invention

The present invention relates to a small-sized antenna module built in a portable communication apparatus and a method for manufacturing the same.

2. Description of the Related Art

A wireless, miniature radio communication device needs an antenna for receiving and transmitting a radio wave, and generally comprises a small-sized built-in antenna having good sensitivity. As such a small-sized antenna, a planar inverted F type antenna and an S type antenna are conventionally well known.

As shown in FIG. 1, the planar inverted reserve F type antenna comprises a plate-like antenna element 12 placed on a parallel with an earth plate 11, a short pin 13 set up between the earth plate 11 and the plate-like antenna element 12, and a feeding line 14 to the plate-like antenna element 12. Input impedance to the antenna is matched by adjusting a space s between the short pin 13 and the feeding line 14. A length 1 of the plate-like antenna element 12, a width w, and a height h of the antenna are parameters of a resonance frequency. A band width becomes wider as height h is larger.

In using the planar inverted F type antenna, an ambient length of the antenna needs about a half wavelength in the basic shape. Therefore, if the antenna is miniaturized, the impedance matching between the antenna and the feeding system occasionally cannot be achieved.

As shown in FIG. 2, the S type antenna is a small-sized vertically polarized antenna, which is mounted above the upper surface of a housing 15 of the miniature radio communication apparatus. Also, the S type antenna is a top-load type antenna in which a feeding portion has a folded structure. Since a top-load portion 16 is S-like shaped, this type of antenna is called as S type antenna.

In the S type antenna, the main parameters determining an antenna characteristic are distance d between the feeding line and the short pin, a height h' of a skirt portion 17, and a gap g between the skirt portion 1 and the housing 15. The directivity of the S type antenna becomes substantially a complete round in a horizontal plane, and the gain of the S type antenna is substantially the same as that of a half wave length dipole antenna.

In the conventional planar inverted F type antenna and S type antenna, an antenna element conducting member and a ground conducting member are prepared by a plate work, and these members and an insulating member are assembled so as to have a predetermined positional relationship among them. After assembling, the dimension between the ground conducting member and the antenna element conducting member is influenced by dimensional accuracy of the plate work and the insulating member, and by the assembly accuracy of each member. Due to this, it is difficult to realize the high accuracy of the size. Therefore, the antenna characteristic varies.

Moreover, in the conventional antennas, it is required that metallic plates constituting the antenna element conducting member and the ground conducting member have thickness of 0.2 mm or more so as to maintain their shapes. This prevents the antenna from being lightened.

As mentioned above, the conventional antenna is insufficient for a built-in antenna for a miniature radio communication device in terms of the dimension accuracy, the size, and the weight, and it is difficult to realized the required performance.

SUMMARY OF THE INVENTION

An object of the present invention is to provide an antenna module which is small and light and has high dimention accuracy, and is suitable for an antenna such as a portable communication device, and a method for manufacturing the antenna module.

According to an aspect of the present invention, these is provided an antenna module comprising: a resin member formed by molding to be a predetermined shape; a sheet-like ground conducting layer adhered to one surface of said resin member; a sheet-like antenna element conducting layer adhered to another surface opposing to said one surface of said resin member; and a feeder for feeding electricity to said antenna element conducting layer.

According to another aspect of the present invention, there is provided a method for manufacturing an antenna module comprising the steps of: providing a molding die having a cavity for molding a resin member; setting a ground conducting layer and an antenna element conducting layer at a predetermined position in the cavity; and molding the resin member integrate with the ground conducting layer and the antenna element conducting layer by injecting molten resin into the cavity.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

The embodiments of the present invention will be explained with reference to drawings.

Figure 1:
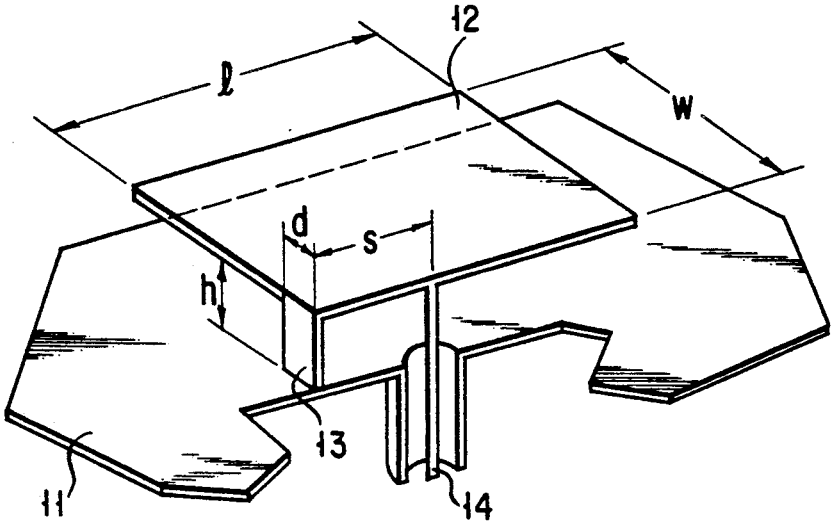
FIG. 1 (PRIOR ART)
FIG. 1 is a perspective view showing a conventional reverse F type antenna.
Figure 2:
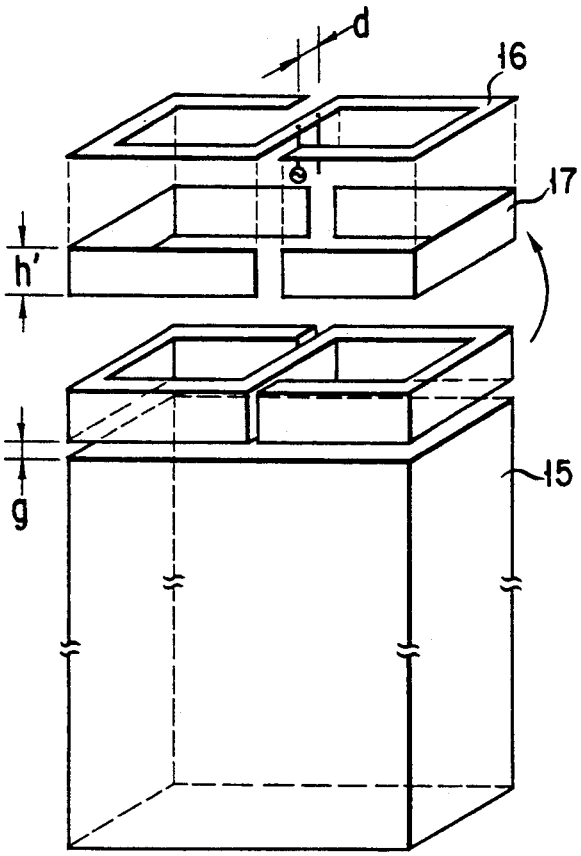
FIG. 2 (PRIOR ART)
FIG. 2 is an exploded view in perspective showing a conventional S type antenna.
Figure 3:
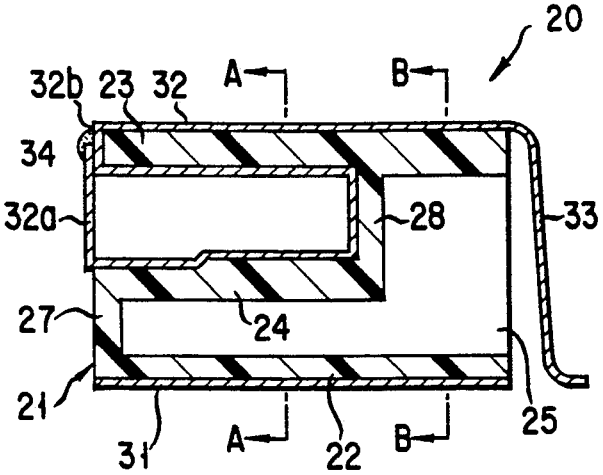
FIG. 3 is a cross sectional view showing an antenna module according to one embodiment of the present invention.
Figure 4:
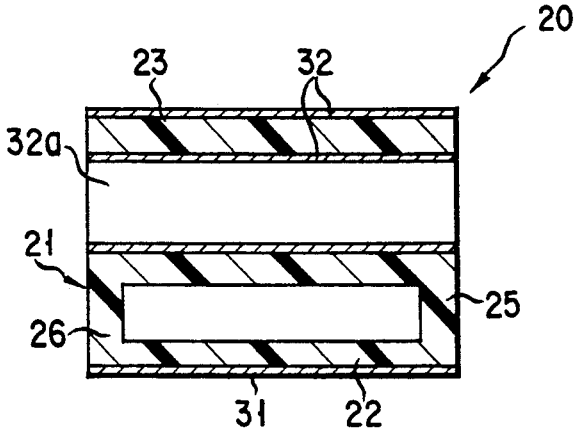
FIG. 4 is a cross sectional view taken on line A—A of the antenna module of FIG. 3.
Figure 5:
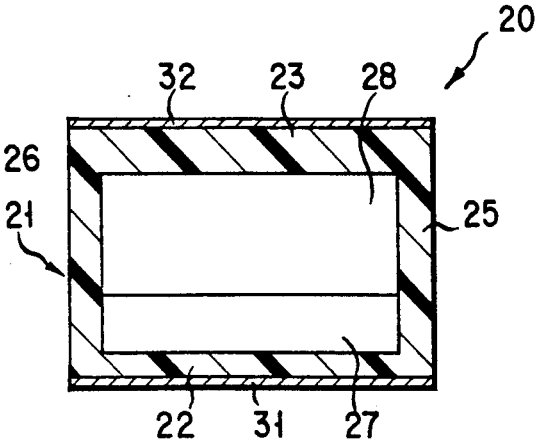
FIG. 5 is a cross sectional view taken on line B—B of the antenna module of FIG. 3.

FIG. 3 is a cross sectional view showing an antenna module relating to one embodiment of the present invention. FIGS. 4 and 5 are cross sectional views taken on line A—A and line B—B of the antenna module of FIG. 3, respectively. An antenna module 20 has a resin member 21. The resin member 21 is integrally formed to be a hollow-box type structure by molding. The resin member 21 comprises a bottom plate 22, an upper plate 23, an intermediate plate 24, side walls 25 and 26, and end wall 27, and an intermediate wall 28.

A sheet-like ground conducting layer 31 is attached to a lower surface of the bottom plate 22. Also, a sheet-like antenna element conducting layer 32 is attached along the upper surface, the end surface, the lower surface of the upper plate 23, the surface of the intermediate wall 28, and the upper surface of the intermediate plate 24. An end portion 32*a* of the antenna element conducting layer 32 extends upward at the end of the intermediate wall 24, and is bonded to an intermediate portion 32*b* corresponding to the end surface of the upper pate 23 of the conducting layer 32 by means of solder 34. A feeder 33 is drawn from the other end of the antenna element conducting layer 32, and is formed to be integral with the conducting layer 32. In other words, the antenna element conducting layer 32 and the feeder 33 are formed of the same sheet.

Since a part of the antenna element conducting layer is a closed loop structure for the above-structured antenna module, the antenna module of this type is called as a P type antenna. Due to the above-mentioned structure, an antenna having a wide bandwidth and a high gain can be obtained. A resonance frequency can be adjusted by adjusting the distance between the ground conducting layer 31 and the antenna element conducting layer 32. The present invention is not limited to the above-mentioned type. An antenna module in which the antenna element conducting layer and the ground conducting layer are formed on at least surfaces of the resin member which are opposite to each other can be applied to the present invention.

As a material for the resin member 21, a material which has high mechanical strength and a small dielectric loss tangent is preferably used. For example, there can be used thermosetting resin such as epoxy resin and the like, and thermoplastic resin such as polyphenylenesurlfone, polyester, and the like.

The ground conducting layer 31, the antenna element conducting layer 32, and the feeder 33 are formed of a complex material in which a metallic foil (copper foil is typically used), which is generally used in a FPC (flexible printed circuit board), and a plastic film are laminated. For example, there can be used the complex material in which the rolled copper foil having a thickness of 35 μm and a polyimide film having a thickness of 50 μm are laminated.

Figure 6:
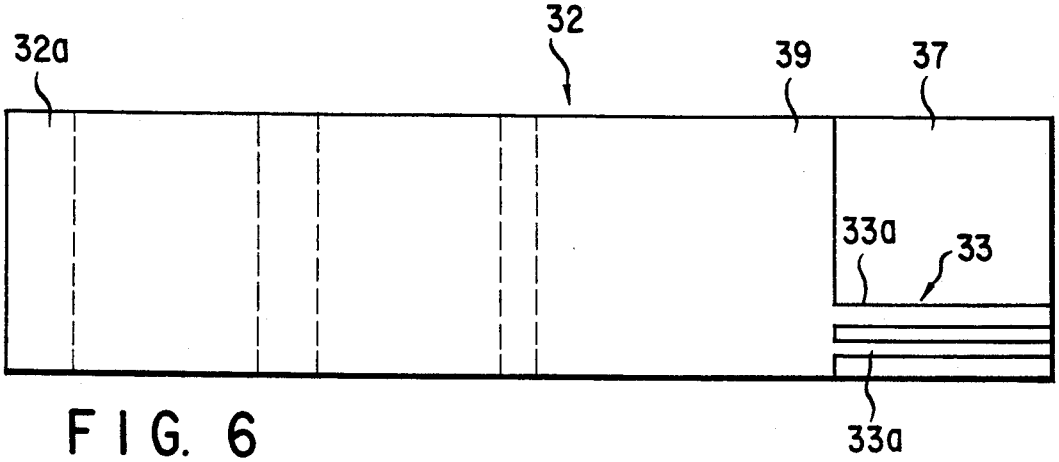
FIG. 6 is a plane view showing a state that an antenna element conducting layer of the antenna module of FIG. 3 is expanded.
Figure 7:
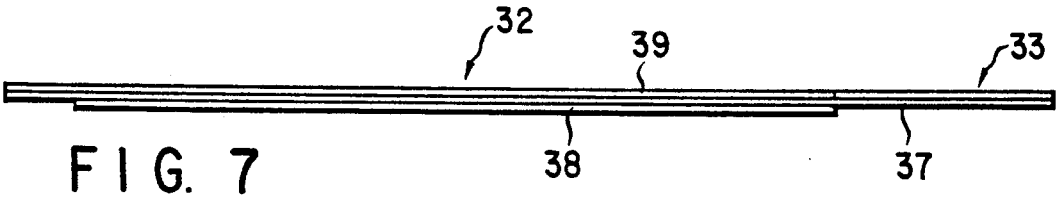
FIG. 7 is a side view showing a state that the antenna element conducting layer of the antenna module of FIG. 3 is expanded.

FIG. 6 is a plane view showing a state that the antenna element conducting layer 32 of the antenna module is expanded, and FIG. 7 is a side view showing a state that the antenna element conducting layer 32 of the antenna module is expanded. The antenna element conducting layer 32 and the feeder 33 comprise a plastic film 37 and a copper foil 39 laminated on the film 37, and is formed by pattern-etching the copper foil 39. In attaching the antenna element conducting layer 32 to the resin-formed member 21, an adhesive 38 is applied to a surface corresponding to the antenna element conducting layer 32 of the film 37, and half-hardened, thereafter, an outline working is provided. In a portion corresponding to the feeder 33, there are formed two thin and long copper foil portions 33*a* by pattern-etching, and one of two thin and long copper foil portions is used as a short pin. In FIG. 6, a broken line shows a bending portion.

Figure 8:
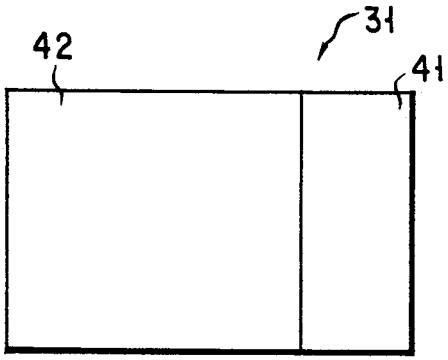
FIG. 8 is a plane view showing a state that a ground conducting layer of the antenna module of FIG. 3 is expanded.
Figure 9:
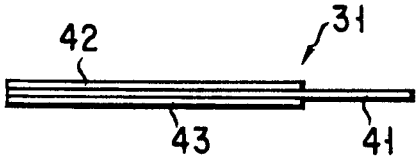
FIG. 9 is a side view showing a state that the ground conducting layer of the antenna module of FIG. 3 is expanded.

FIGS. 8 and 9 are a plane view and a side view each showing a state that the ground conducting layer 31 of the antenna module is expanded. The ground conducting layer 31 comprises a plastic film 41 and a copper foil 42 laminated on the film 41, and is formed by pattern-etching the copper foil 42. In attaching the ground conducting layer 31 to the resin-formed member 21, an adhesive 43 is applied to a surface corresponding to the ground conducting layer 31 of the film 41, and half-hardened, thereafter, an outline working is provided.

Since the ground conducting layer 31, the antenna element conducting layer 32, and the feeder 33 are formed as mentioned above, they can be easily formed by an etching method as is used for printed circuit boards, and particularly, strength against the bending of the root of the feeder 33 can be improved because it has the raminate structure described above.

Since one copper foil potion 33*a* serves as a feeder and another copper foil portion 33*a* serves as a short pin which not easily separated, the antenna module can be easily handled.

It is needless to say that the ground conducting layer 31, the antenna element conducting layer 32, and the feeder 33 may be formed of only the metallic foil. Particularly since the pattern of the ground conducting layer 31 is simple, it is sufficient that the ground conducting layer 31 is formed of only the metallic foil.

A manufacturing method of the above-structured antenna module will be explained.

Figure 10:
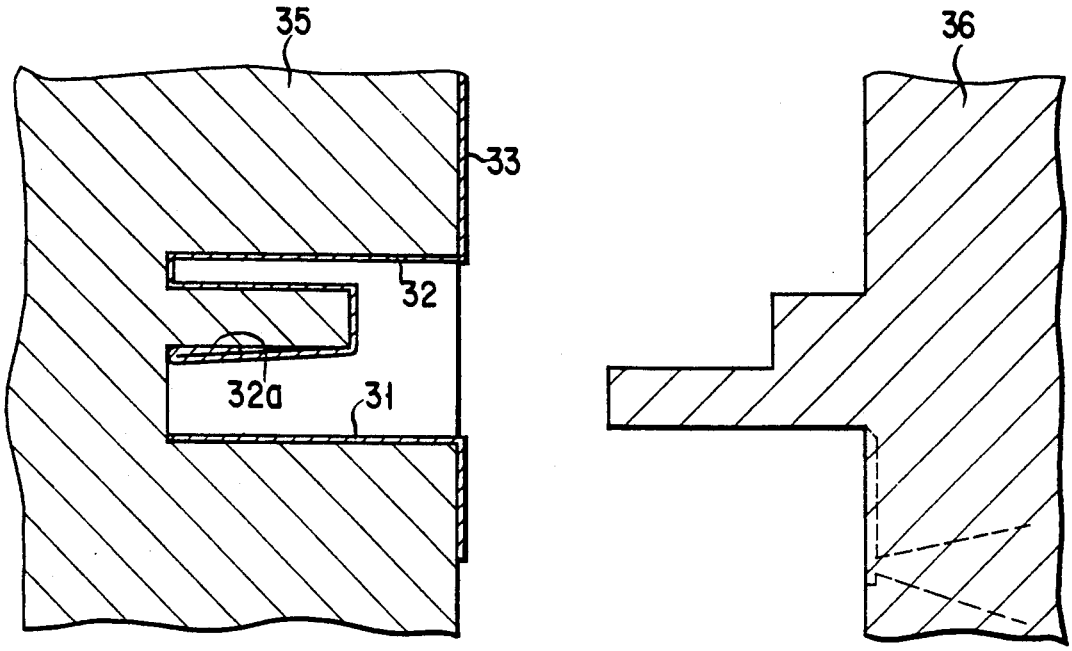
FIG. 10 is a cross sectional view showing a pair of dies in molding the antenna module of FIG. 3.

First of all, as shown in FIG. 10, molding dies 35 and 36 for molding the resin member 21 are prepared, and the above-structured ground conducting layer 31 and the antenna element conducting layer 32 are set in the inner surface of the cavity of the molding die 35 in the state that the adhesive is applied to the inner surfaces of these layers. The feeder 33 continuous with the antenna element conducting layer 32 is positioned at the outside portion of the cavity, that is, the facing portion of the dies. If there is an extra portion in the ground conducting layer 31, the extra portion is also positioned at the outside portion of the cavity.

In the molding die 35, the antenna element conducting layer 32 is set in a state that the end portion 32*a* is folded at 180°. In this state, standing up the end portion 32*a*, a closed loop of the antenna element can be formed.

Figure 11:
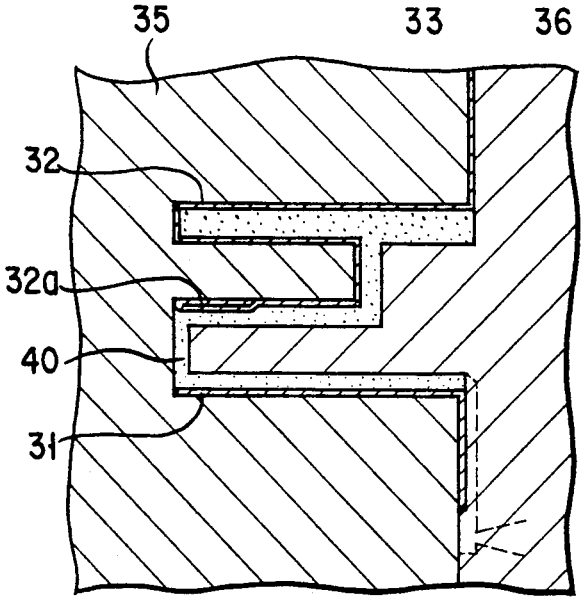
FIG. 11 is a cross sectional view showing a state that the antenna module of FIG. 3 is molded.
Figure 12:
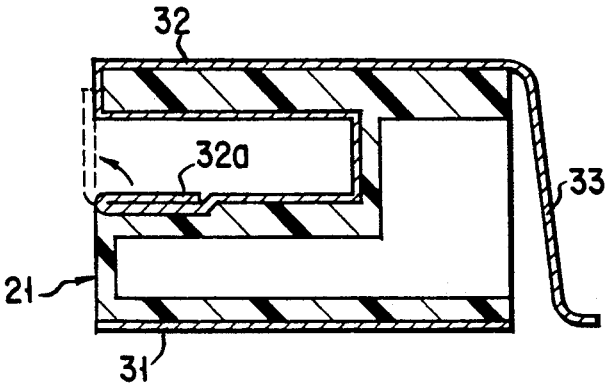
FIG. 12 is a cross sectional view showing the antenna module which is taken out of the pair of dies after the antenna module of FIG. 3 is molded as shown in FIG. 11.

Thereafter, the molding dies 35 and 36 are closed, and an injection forming, in which melted resin 40 is injected into the cavity, is performed as shown in FIG. 11. If the molding dies 35 and 36 are opened after hardening resin 40, a molding product in which the resin member 21, the antenna element conducting layer 32, and the ground conducting layer 31 are integrally formed can be obtained as shown in FIG. 12.

Thereafter, the end portion 32*a* of the antenna element conducting layer 32 is stood up as shown in a dotted line, and the top end is soldered to the intermediate portion 32*b*, thereby completing an antenna module shown in FIG. 3.

According to the above-mentioned structure, since the ground conducting layer 31 and the antenna element conducting layer 32 are adhered to the resin member 21, these conducting layers do not need to have mechanical strength for maintaining the predetermined shape, and these layers can be formed in thin sheet-like, so that the the antenna module can be lightened.

Since the molded resin member is used, the size of the gap between the ground conducting layer 31 and the antenna element conducting element layer 32 is defined by the size of the mold die. Therefore, high accuracy of the size can be realized.

Moreover, since the antenna element conducting layer 32 and the feeder 33 are integrally and continuously formed, the connection between the feeder 33 and the antenna element conducting layer 32 is unnecessary. Therefore, assembly and reliability can be improved.

Furthermore, since the resin formed member 21 has a hollow structure, the dielectric loss tangent between the antenna element conducting layer 32 and the ground conducting layer 31 can be reduced, and this contributes for lightening the antenna module. However, there is no problem as long as a predetermined characteristic can be obtained even if the resin member 21 has the solid structure.

By use of the above-mentioned manufacturing method, the molding of the resin member 21 and the adherence of the antenna element conducting layer 32 and the ground conducting layer 31 to the resin member 21 can be simultaneously carried out. Therefore, the manufacturing process can be simplified, and the antenna module can be manufactured at low cost.

The other embodiment of the present invention will be explained. This explains a suitable formation of the antenna module when mounting on the print circuit board.

Figure 13:
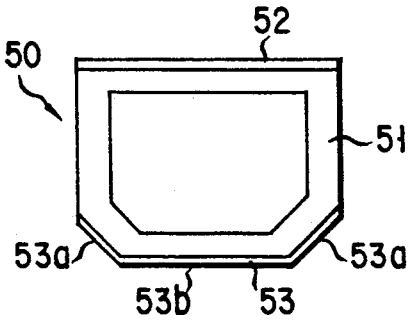
FIG. 13 is a front view showing an antenna module relating to the other embodiment of the present invention.
Figure 14:
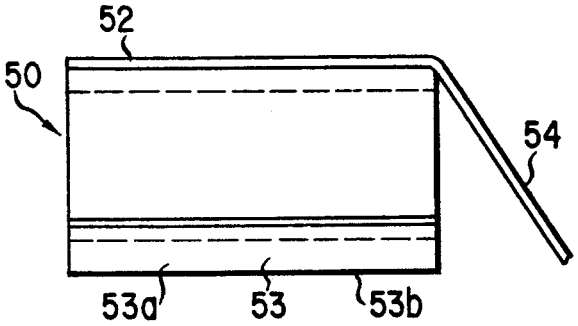
FIG. 14 is a side view showing the antenna module of FIG. 13.

FIG. 13 is a front view showing an antenna module relating to the other embodiment of the present invention, and FIG. 14 is a side view thereof. In these drawings, the basic structure of an antenna module 50 is the same as the antenna module 20 of the first embodiment. An antenna element conducting layer 52 is formed on the upper surface of a hollow resin member 51, and a ground conducting layer 53 is formed on the lower surface of the hollow resin-formed member 51. This embodiment is different from the first embodiment in that the antenna element conducting layer is not loop-shaped. Reference numeral 54 denotes a feeder.

The module is mounted on the print circuit board in a state that the surface of the ground conducting layer 53 is opposed to the surface of the board. In this embodiment, a corner portion 53*a* of the surface of the ground conducting layer 53, which is a portion to be soldered, is formed to be inclined to a portion 53*b* opposing to the board in mounting the print circuit board.

Figure 15:
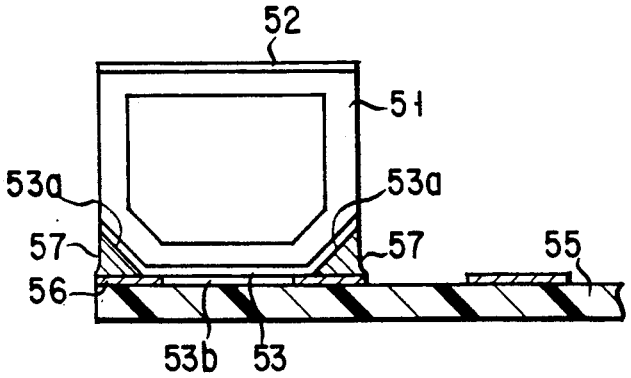
FIG. 15 shows a state that the antenna module of FIG. 13 is mounted on a print circuit board.

FIG. 15 shows a state that the antenna module 50 is mounted on the printed circuit board 55. In this drawing, reference numeral 56 denotes a circuit conductor, and the corner portion 53*a* of the surface of the ground conducting layer 53 is soldered to the circuit conductor 56 by solder 57. In this case, since the corner portion 53*a* to be soldered is an inclined surface, solder 57 can enter the portion between the ground conducting layer 53 and the circuit conductor 56. As shown in FIG. 15, even if the antenna module 50 is mounted on the peripheral portion of the circuit board 55, soldering can be surely made.

The following explains still another embodiment of the present invention. In this embodiment, there is explained the antenna module in which the antenna characteristic can be controlled in a state that the antenna module is mounted on the printed circuit board.

In a case where the antenna module is actually mounted on the printed circuit board or provided in the housing, there often occurs a case in which the antenna characteristic is not fully satisfied by the influence of the printed circuit board or the housing even if the antenna module itself has sufficient characteristics. In order to overcome such an disadvantage, the antenna module may be structured such that the antenna characteristic can be controlled after mounting the antenna module.

Figure 16:
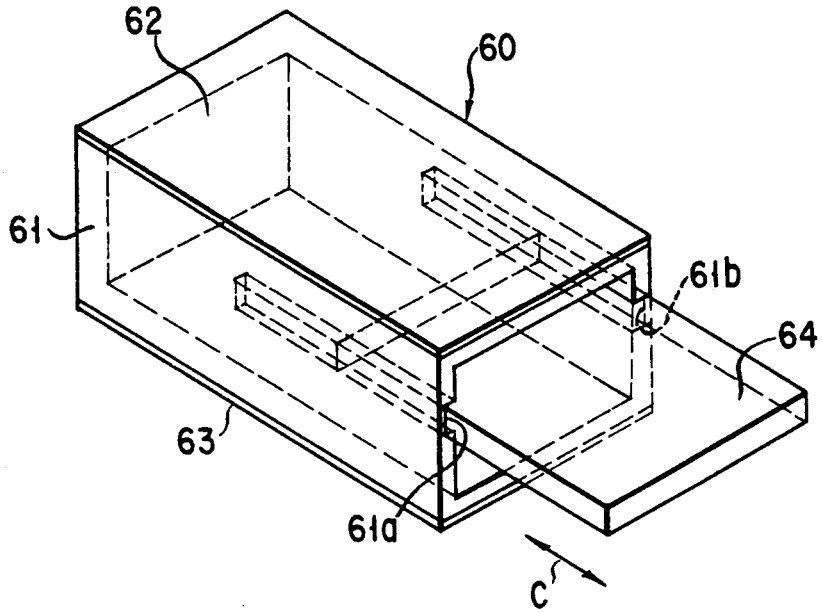
FIG. 16 is a perspective view showing an antenna module relating to further other embodiment of the present invention, and one example of the antenna modules, which can adjust an antenna characteristic.

FIG. 16 is a perspective view showing one example of the antenna modules, which can adjust the antenna characteristic. The basic structure of an antenna module 60 is the same as the antenna module of FIG. 13. An antenna element conducting layer 62 is formed on the upper surface of a hollow molded resin member 61, and a ground conducting layer 63 is formed on the lower surface of the hollow resin member 61. Guide grooves 61*a* and 61*b* are formed inside of the side wall of the resin member 61. A plate 64 formed of, for example a resin, is contained in the resin member 61 in a state that the movable plate 64 is inserted into the guide grooves 61*a* and 61*b*. In this drawing, feeder is not shown.

The movable plate 64 is moved along an arrow C, so that the capacity between the antenna element conducting layer 62 and the ground conducting layer 63 can be changed. Due to this, the antenna characteristic can be conformed to the desirable characteristic. In other words, even if the antenna characteristic is shifted in mounting the antenna module 60 on the printed circuit board or providing the antenna module in the housing the antenna characteristic can be controlled by the movable plate 64.

After controlling the antenna characteristic, the movable plate 64 is fixed to the resin member 61, and a portion projecting from the resin member 61 of the movable plate 64 is cut.

The material for the movable plate 64 is not limited to resin, and other materials may be used. The resin member 60 may be solid structure. In this case, there may be formed a space in which the movable plate 64 can be moved.

Figure 17:
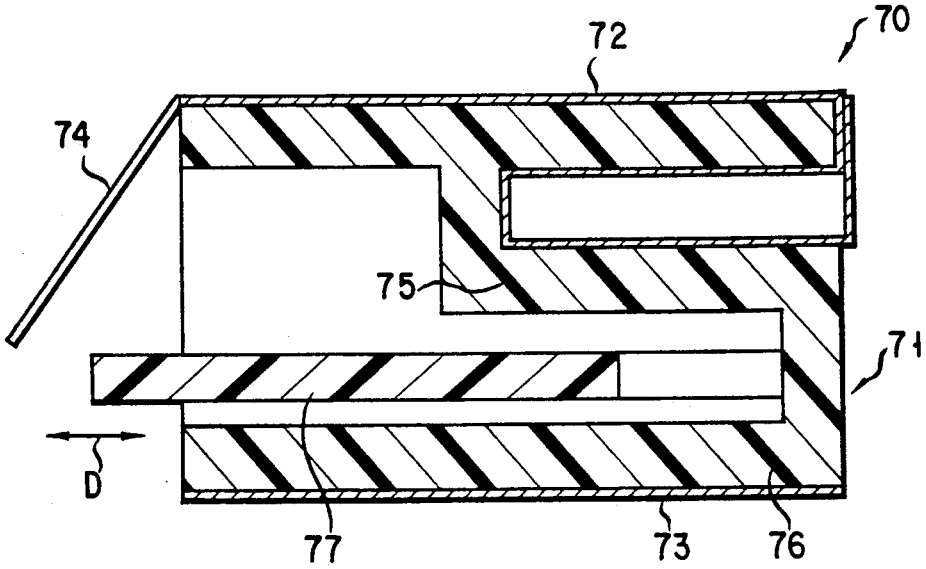
FIG. 17 is a cross sectional view showing an example in which a movable plate of FIG. 16 is applied to a P type antenna.

In a case where such a movable plate is applied to the P type antenna module, the structure as shown in FIG. 17 is used. According to the structure of an antenna module 70, an antenna element conducting layer 72 is formed on the upper surface of a hollow resin member 71 and a ground conducting layer 73 is formed on the lower surface thereof, and a feeder 74 is drawn from the antenna element conducting layer 72. Then, a movable plate 77 having the same structure as the movable plate 64 is provided in the resin member 71 to be movable along the direction of an arrow D. One end of the movable plate 77 is formed to be inserted between an intermediate plate 75 of the resin member 71 and a bottom plate 76. Similar to the antenna module of FIG. 16, the antenna characteristic can be controlled according to the above-mentioned structure.

Figure 18:
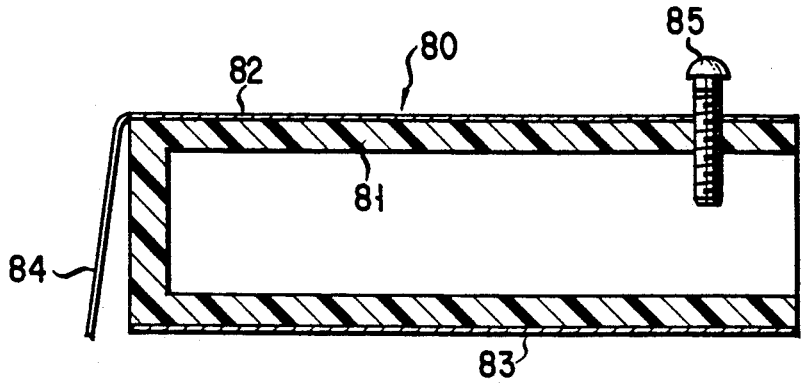
FIG. 18 is a cross sectional view showing other example of the antenna module, which can adjust the antenna characteristic.

FIG. 18 is a cross sectional view showing another example of the antenna module, which can adjust the antenna characteristic. The basic structure of an antenna module 80 is the same as that of FIG. 16. An antenna element conducting layer 82 is formed on the upper surface of a hollow resin member 81 and a ground conducting layer 83 is formed on the lower surface thereof, and a feeder 84 is drawn from the antenna element conducting layer 82. In this example, a screw 85 formed of a conductor is provided so a to be through the antenna element conducting layer 82 from the upper side of the conducting layer 82. The screw 85 is electrically connected to the antenna element conducting layer 82. The distance between the top end of the screw 85 and the ground conducting layer 83 can be changed by rotating the screw 85.

Therefore, the capacity between the antenna element conducting layer 82 and the ground conducting layer 83 is changed, and the antenna characteristic can be controlled to be a desirable value.

The screw may be provided in the ground conducting layer 83. In this case, the screw may be also used as a screw for fixing the antenna module to the print circuit board. Also, a plurality of screws may be used for adjusting the capacity. The screw may not be formed of the conductor. In consideration of taking a large adjusting width, the screw is preferably formed of the conductor.

Figure 19:
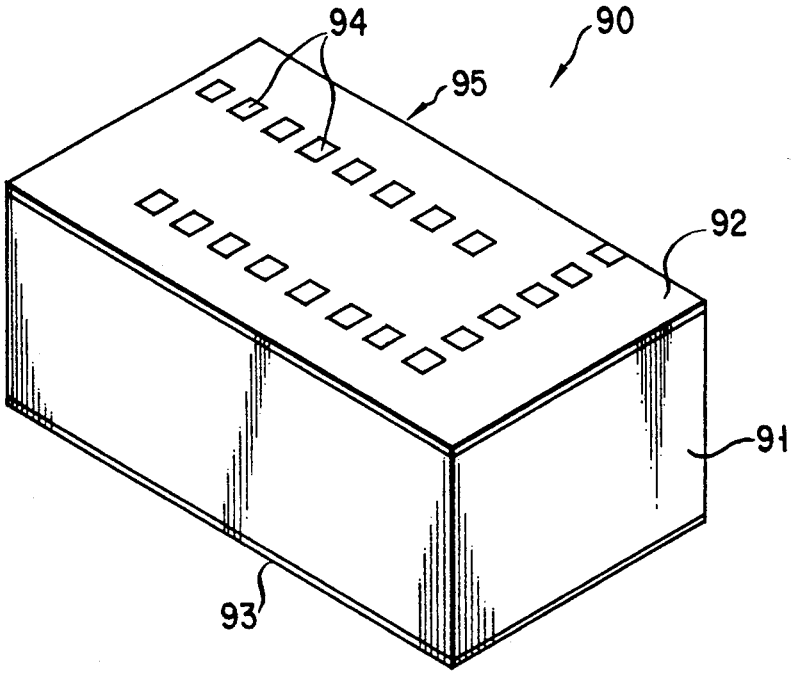
FIG. 19 is a perspective view showing further other example of the antenna module, which can adjust the antenna characteristic.

FIG. 19 is a perspective view showing still another example of the antenna module, which can adjust the antenna characteristic. The basic structure of an antenna module 90 is the same as that of FIG. 16. An antenna element conducting layer 92 is formed on the upper surface of a hollow resin member 91 and a ground conducting layer 93 is formed on the lower surface thereof, and a feeder (not shown) is drawn from the antenna element conducting layer 92.

In the antenna element conducting layer 92, there is formed a trimming pattern 95 in which a plurality of trimming portions 94 are arranged.

In a case where the antenna characteristic is controlled, the trimming portions 94 are trimmed one by one from the end one by means of a laser, thereby removing the portions 94 one by one. Due to this, an inductance component in the longitudinal direction of the antenna element conducting layer 92 can be digitally changed, and the antenna characteristic can be con trolled to be a desirable value.

Figure 20:
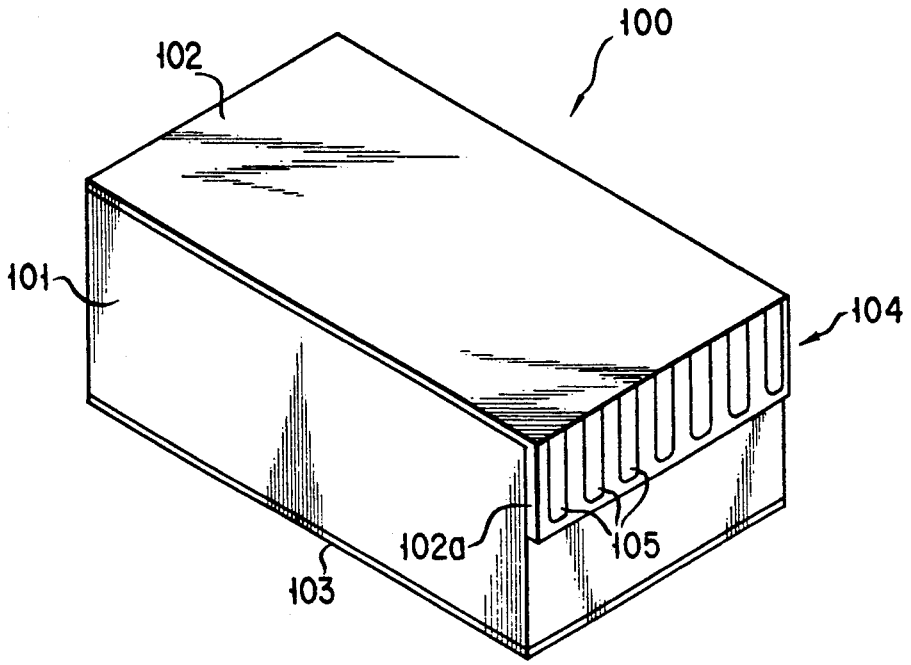
FIG. 20 is a perspective view showing further other example of the antenna module, which can adjust the antenna characteristic.

FIG. 20 is a perspective view showing still another example of the antenna module, which can adjust the antenna characteristic. The basic structure of an antenna module 100 is the same as that of FIG. 16. An antenna element conducting layer 102 is formed on the upper surface of a hollow resin member 101 and a ground conducting layer 103 is formed on the lower surface of the hollow resin-formed member 101, and a feeder (not shown) is drawn from the antenna element conducting layer 102.

One end portion **102*a* of the antenna element conducting layer 102 is folded downwardly, and a trimming pattern 104 having a plurality of comb-like portions 105 is formed in the folded end portion 102*a*. In a case where the antenna characteristic is controlled, the comb- like portions 105 of the trimming pattern 104 are trimmed and removed by a laser. Due to this, the capacity between the antenna element conducting layer 102 and the ground conducting layer 103** can be changed, and the antenna characteristic can be controlled to be a desirable value.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A P-type antenna module comprising:

a resin molding shaped to include first and second plate-like portions that are spaced apart from each other such that said first and second plate-like portions face each other, and an intermediate portion that connects said first and second plate-like portions such that a recess is defined in said resin molding between at least one of said first and second plate-like portions and said intermediate portion;

a sheet-like ground conducting layer mounted on an outer surface of one of said first and second plate-like portions;

an antenna element conducting layer, including:

a flat portion, mounted on an outer surface of the other one of said first and second plate-like portions; and a looped portion connected to a first end portion of said flat portion of said antenna element conducting layer, said looped portion extending along said recess defined in said resin molding; and a power supply conductor connected to a second end portion of said flat portion of said antenna element conducting layer, for supplying an electric power to said antenna element conducting layer.

2. The antenna module according to claim 1, wherein said power supply conductor is formed integrally with said antenna element conducting layer.

3. The antenna module according to claim 2, wherein said antenna element conducting layer and said power supply conductor are formed from a common sheet of material.

4. The antenna module according to claim 3, wherein said antenna element conducting layer and said power supply conductor comprise a laminated material that includes a metallic foil and a plastic film.

5. The antenna module according to claim 1, wherein said antenna element conducting layer comprises a laminated material that includes a metallic foil and a plastic film.

6. The antenna module according to claim 1, wherein said ground conducting layer comprises a laminated material including a metallic foil and a plastic film.

7. The antenna module according to claim 1, wherein a surface of said antenna module that is to be opposed to a board surface on which said antenna module is to be mounted, has a soldering portion, and the soldering portion is inclined relative to another portion of said surface of said antenna module.

8. The antenna module according to claim 7, wherein said soldering portion is formed on a peripheral portion of said surface so as to be opposed to the board surface on which said antenna module is mounted.

9. The antenna module according to claim 1, further comprising control means for controlling an antenna characteristic of the antenna module.

10. The antenna module according to claim 9, wherein:

said control means includes a movable member, that is insertable into an inside portion of said resin molding, said movable member being movable in a direction that is parallel to said antenna element conducting layer and said ground conducting layer; and a capacitance between said antenna element conducting layer and said ground conducting layer is adjustable by a movement of said movable member.

11. The antenna module according to claim 10, wherein said movable member comprises a resin material.

12. The antenna module according to claim 11, wherein:

said resin molding has a hollow body;

said control means has a projection member that projects into an inside portion of said resin molding from one of said antenna element conducting layer and said ground conducting layer so as to be movable in a direction perpendicular to said one of said antenna element conducting layer and said ground conducting layer; and a capacitance between said antenna element conducting layer and said ground conducting layer is adjustable by a movement of said projection member.

13. The antenna module according to claim 12, wherein said projection member comprises a conductor, that is electrically connected to said one of said antenna element conducting layer and said ground conducting layer.

14. The antenna module according to claim 9, wherein:

said control means comprises a trimming pattern formed in said antenna element conducting layer, said trimming pattern including a plurality of trimming portions; and an inductance component of said antenna element conducting layer is adjustable by a one by one removal of said plurality of trimming portions.

15. The antenna module according to claim 9, wherein:

said control means has a trimming pattern that is formed to be continuous with an extended portion of said antenna element conducting layer that extends toward said ground conducting layer;

said trimming pattern includes a plurality of trimming portions; and a capacitance between said antenna element conducting layer and said ground conducting layer is adjustable by a one by one removal of said plurality of trimming portions.

16. A method of manufacturing a P-type antenna module, comprising the steps of:

preparing a mold having a cavity that is usable for preparing a resin molding;

placing at predetermined positions at an end portion inside said cavity of the mold, a ground conducting layer and an antenna element conducting layer that are spaced apart from each other and face each other;

folding back an end portion of said antenna element conducting layer onto another portion of said antenna element conducting layer at an angle of substantially 180° to form a band in said antenna element conducting layer, said bend in said antenna element conducting layer adjoining said end portion of said cavity of said mold such that said folded back end portion of said antenna element conducting layer is pullable out from a folded back position thereof after said resin molding is removed from said mold;

placing a power supply conductor outside the mold cavity, and connecting said power supply conductor to said antenna element conducting layer;

pouring a molten resin into said mold cavity to obtain said resin molding such that said ground conducting layer and said antenna element conducting layer are integrally bonded to said resin molding in said spaced apart relation upon a hardening of said molten resin;

removing said resin molding from the mold after said resin molding hardens;

pulling out said folded back end portion of said antenna element conducting layer; and then bonding said pulled out end portion of said antenna element conducting layer, to an intermediate portion of said antenna element conducting layer to form a loop portion of the p-type antenna module.

* * * * *